United States Patent [19]

Baranow

[11] 4,111,685

[45] Sep. 5, 1978

[54] DISPERSION-STRENGTHENED COBALT-BEARING METAL

[75] Inventor: Sanford Baranow, Sauquoit, N.Y.

[73] Assignee: Special Metals Corporation, New Hartford, N.Y.

[21] Appl. No.: 738,770

[22] Filed: Nov. 4, 1976

[51] Int. Cl.[2] ..... C22C 19/00

[52] U.S. Cl. ..... 75/951; 75/134 F; 75/171; 148/11.5 P

[58] Field of Search ..... 148/11.5 P; 75/134 F, 75/951, 171

[56] References Cited

U.S. PATENT DOCUMENTS

| | | | |
|---|---|---|---|
| 3,837,930 | 9/1974 | Cairns et al. | 148/11.5 P |
| 3,847,680 | 11/1974 | Fustukian et al. | 148/11.5 P |
| 3,929,467 | 12/1975 | Davies et al. | 75/171 |

*Primary Examiner*—M. J. Andrews

*Attorney, Agent, or Firm*—Vincent G. Gioia; Robert F. Dropkin

[57] ABSTRACT

Oxide dispersion-strengthened metal having from 18 to 35% chromium, 3 to 7% aluminum, 0.2 to 3.0% of an oxide dispersoid, 10 to 45% nickel and at least 30% cobalt. The oxide dispersoid has a negative free energy of formation at 1000° C of at least as great as that of aluminum oxide.

9 Claims, No Drawings

DISPERSION-STRENGTHENED COBALT-BEARING METAL

The present invention relates to oxide dispersion-strengthened metal particularly suitable for use in applications requiring high temperature strength and hot corrosion resistance.

Hardware subjected to high temperatures in a marine environment is prone to a phenomenon known as hot corrosion. Salt in the air and sulfur in the fuel combine to form a destructive corrosive medium. As a result, such parts are invariably coated to enhance their resistance to hot corrosion. Through the present invention, there is provided a material having sufficient hot corrosion resistance to render coating unnecessary. Moreover, this material has both the strength and oxidation resistance required for high temperature operations.

Speaking broadly, the present invention calls for coarse grained oxide dispersion-strengthened metal having from 18 to 35% chromium, 3 to 7% aluminum, 0.2 to 3.0% of an oxide dispersoid, 10 to 45% nickel and at least 30% cobalt. Insofar as it contains at least 30% cobalt it is significantly different from the dispersion-strengthened metal disclosed in U.S. Pat. No. 3,743,548. It is also significantly different from the cobalt-bearing alloys disclosed in the following Air Force Materials Laboratory Technical Reports: AFML-TR-74-34 (March 1974); Interim Technical Report Contract No. F 33615-75-C-5061 (Apr. 30, 1975); and Interim Technical Report Contract No. F 33615-75-C-5061 (Sept. 30, 1975). The cobalt-bearing alloys disclosed therein contain either nominal chromium contents of 16% or aluminum contents no higher than 1%; and, moreover, on recrystallization generally have small, equiaxed grains in those instances when an alloy of low dynamic modulus of elasticity is attained.

It is accordingly an object of the present invention to provide oxide dispersion-strengthened metal particularly suitable for use in applications requiring high temperature strength and hot corrosion resistance.

The oxide dispersion-strengthened metal of the present invention consists essentially of, by weight, from 18 to 35% chromium, 3 to 7% aluminum, 0.2 to 3.0% of at least one oxide dispersoid, 10 to 45% nickel, up to 10% iron, up to 0.1% boron, up to 2.0% titanium, up to 1.5% hafnium, up to 3.0% vanadium, up to 4.0% of elements from the group consisting of molybdenum, tungsten and rhenium, up to 4.0% tantalum, up to 1.0% yttrium, up to 1.0% lanthanum, up to 1.0% cerium, up to 0.1% carbon, balance essentially cobalt. The oxide dispersoids are those having a negative free energy of formation at 1000° C. of at least as great as that of aluminum oxide. Oxides of yttrium and thorium are preferred. The cobalt content of the metal is at least 30%. The metal is characterized by coarse grains with (001) planes perpendicular to the direction of working, thereby having a low dynamic modulus of elasticity in the longitudinal direction.

The metal preferably contains, individually or as a group, from 20 to 28% chromium, 3.5 to 6.5% aluminum, 15 to 35% nickel, from 0.5 to 2.0% of at least one oxide dispersoid and at least 40% cobalt. Chromium and cobalt enhance the hot corrosion resistance of the metal; aluminum and chromium increases its oxidation resistance; and nickel stabilizes its face-centered-cubic structure.

The following examples are illustrative of several aspects of the invention.

EXAMPLE I

Powder having the following overall composition: Co-25 Ni-22 Cr-5 Al-1.0 $Y_2O_3$, was packed into a mild steel container which was evacuated, sealed and extruded at 2200° F. with a reduction in area of 20:1. The container was then removed, and a sample of the metal was recrystallized at 2450° F. The metal had a relatively coarse-grained texture and (001) planes perpendicular to the direction of working. In a stress-rupture test at 2000° F. a specimen lasted 10.2 hours at 8 ksi with an elongation of 10.9% and a reduction in area of 23.2%. A most desirable combination of strength and ductility.

EXAMPLE II

A half-inch diameter by one-quarter inch deep hole was drilled in a sample of metal having the following composition: Ni-16 Cr-5 Al-1 $Y_2O_3$. The sample was subsequently stress relieved for 1 hour at 1600° F. Thereafter, the hole was cleaned to remove traces of oxidation, using 600 grit abrasive paper. The hole was then filled with a mixture of 90% sodium sulfate and 10% sodium chloride, and heated in a box furnace at 1700° F. for about 15 hours. Such a test gives an indication of a material's hot corrosion resistance. In this instance the hot corrosion resistance of the alloy was poor. Note that the alloy is one from heretofore referred to U.S. Pat. No. 3,743,548.

EXAMPLE III

Dispersion-strengthened metal having the following composition: Co-25 Ni-22 Cr-5 Al-1 $Y_2O_3$, was tested as was the metal in Example II. In this instance, the hot corrosion resistance of the metal was outstanding. Note that this metal is one within the limits of the subject invention.

It will be apparent to those skilled in the art that the novel principles of the invention disclosed herein in connection with specific examples thereof will suggest various other modification and applications of the same. It is accordingly desired that in construing the breadth of the appended claims that they shall not be limited to the specific examples of the invention described herein.

I claim:

1. Coarse grained oxide dispersion-strengthened metal consisting essentially of, by weight, from 18 to 35% chromium, 3 to 7% aluminum, 0.2 to 3.0% of at least one oxide dispersoid, 10 to 45% nickel, up to 10% iron, up to 0.1% boron, up to 2.0% titanium, up to 1.5% hafnium, up to 3.0% vanadium, up to 4.0% of elements from the group consisting of molybdenum, tungsten and rhenium, up to 4.0% tantalum, up to 1.0% yttrium, up to 1.0% lanthanum, up to 1.0% cerium, up to 0.1% carbon, balance essentially cobalt; said oxide dispersoid having a negative free energy of formation at 1000° C. of at least as great as that of aluminum oxide; said metal having at least 30% cobalt; said metal being characterized by a desirable combination of high temperature strength and oxidation resistance, and hot corrosion resistance.

2. Oxide dispersion-strengthened metal according to claim 1, having from 20 to 28% chromium.

3. Oxide dispersion-strengthened metal according to claim 1, having from 3.5 to 6.5% aluminum.

4. Oxide dispersion-strengthened metal according to claim 1, having from 15 to 35% nickel.

5. Oxide dispersion-strengthened metal according to claim 1, having from 0.5 to 2.0% of at least one oxide dispersoid.

6. Oxide dispersion-strengthened metal according to claim 1, having at least 40% cobalt.

7. Oxide dispersion-strengthened metal according to claim 1, characterized by coarse grains and (001) planes perpendicular to the direction of working.

8. Oxide dispersion-strengthened metal according to claim 7, having from 20 to 28% chromium, 3.5 to 6.5% aluminum, 15 to 35% nickel and from 0.5 to 2.0% of at least one oxide dispersoid.

9. Oxide dispersion-strengthened metal according to claim 8, having at least 40% cobalt.

* * * * *